US005488839A

United States Patent [19]

Udko

[11] Patent Number: 5,488,839

[45] Date of Patent: Feb. 6, 1996

[54] ENHANCED BAGUETTE SETTING

[75] Inventor: Richard W. Udko, Beverly Hills, Calif.

[73] Assignee: Unigem International, Beverly Hills, Calif.

[21] Appl. No.: 264,296

[22] Filed: Jun. 23, 1994

[51] Int. Cl.[6] ..... A44C 17/02

[52] U.S. Cl. ..... 63/28; 63/32

[58] Field of Search ..... 63/26, 28, 32

[56] References Cited

U.S. PATENT DOCUMENTS

| | | | |
|---|---|---|---|
| 455,924 | 7/1891 | Näf | 63/32 |
| 992,014 | 5/1911 | Lightbody | 63/32 |
| 1,908,774 | 5/1933 | Maier | 63/32 |
| 2,907,187 | 10/1959 | Karp et al. | 63/28 |
| 3,733,851 | 5/1973 | D'Apuzzo | 63/1.1 |
| 4,030,317 | 6/1977 | Rogell | 63/32 |
| 4,195,493 | 4/1980 | Bogner et al. | 63/26 |
| 4,788,164 | 11/1988 | Che et al. | 501/39 |
| 4,936,115 | 6/1990 | Mesica | 63/26 |
| 5,072,601 | 12/1991 | Slowinski | 63/28 |

FOREIGN PATENT DOCUMENTS

| | | | |
|---|---|---|---|
| 1130992 | 2/1957 | France | 63/32 |
| 2734291 | 2/1979 | Germany | 63/32 |

*Primary Examiner*—Michael J. Milano
*Attorney, Agent, or Firm*—Michael A. Painter

[57] ABSTRACT

A jewelry setting for translucent, diamond baguettes in which the position of the baguette gemstones are interleaved with metallic reproductions of the gemstones to create the illusion of uniformly mounted diamond baguettes. The geometric configuration of a baguette or tapered baguette gemstone is recreated in metal which is the same color as that of the jewelry setting. The baguette gemstones are mounted in the setting adjacent interleaved metallic baguettes. Light refracted through the translucent baguette gemstone will be reflected from the gemstone facets, the surface of the jewelry setting and from reflective facets of the metallic baguette. When combined from the light reflected directly from the crown facets of the metallic baguette, an illusion of uniformly adjacent diamond baguettes is created.

4 Claims, 1 Drawing Sheet

ENHANCED BAGUETTE SETTING

BACKGROUND OF THE DISCLOSURE

1. Field of the Invention

The present invention generally relates to jewelry settings for translucent gemstone baguettes, and more particularly, to jewelry settings which simulate the appearance of contiguously mounted gemstone baguettes.

2. Prior Art

Baguettes are small, rectangular or tapered gemstones or the like which are used in jewelry designs either alone or adjacent larger stones. As an example, diamond baguettes are often mounted about the entire circumference of a band or placed adjacent larger stones. The size of baguettes are generally limited to 1–6 points (i.e., 0.01–0.06 carats). It is generally customary to mount baguettes either in a channel set or a prong set. Irrespective of the mounting method which is used, mounting five point baguettes adjacent one another about the circumference of a typical ring will require 20 or more stones.

As a general rule, the cost of a jewelry design is increased where all set stones are gemstones such as diamonds and the like. In order to reduce the cost of jewelry, it has been common to simulate gemstones with glass or other like substances. Even where gemstones are used to reduce manufacturing costs, the prior art exhibits designs where the setting for each stone is uniformly separated from an adjacent stone. The problem inherent in these approaches is a degradation of appearance. Translucent gemstones cannot be mounted in conjunction with simulated stones or separated from each other without producing an appearance which is vastly different from a design which employs contiguously mounted translucent gemstones.

The present invention resolves those problems inherent in the prior art. A design which employs adjacent diamond baguettes may be simulated by the present invention. Whether using tapered or rectangular diamond baguettes, each genuine stone is separated from an adjacent stone by a baguette having the same geometrical configuration, but manufactured of a metal having the same visual appearance as the setting. The result is a design which reduces the number of diamond baguettes by 50%. A jewelry design constructed in accordance with the present invention produces an appearance of contiguously mounted diamond baguettes at a fraction of the cost thereof.

SUMMARY OF THE INVENTION

The present invention generally relates to a design for setting diamond baguettes which substantially reduces the cost of the product while simultaneously producing substantially the same appearance. A jewelry setting constructed in accordance with the present invention is used with fully translucent baguette gemstones such as diamonds. For the purpose of example only, the present invention will be illustrated and discussed in relationship to the construction of jewelry utilizing channel set mountings for baguettes. It is understood the scope of the present invention includes other conventional jewelry mounting techniques such as prong settings.

In implementing a jewelry setting in accordance with the present invention, baguettes having a uniform geometry are used. Half of the baguettes are translucent gemstones such as diamonds, the remaining baguettes being constructed of the same metal as the setting or, at the least, fabricated of a metal which is visually the same color and has substantially the same degree of reflectivity as the metal used to construct the jewelry setting. The diamond baguettes and metal baguettes are alternatively mounted within the setting and are placed adjacent one another along the longitudinal axis of the setting. When in place, light impinging upon the baguettes will be refracted through the diamond baguette and reflected from the surfaces of the channel setting and from the facets of the adjacent diamond and metallic baguette. Light impinging upon the crown facets of the metallic baguette will be directly reflected or indirectly reflected and refracted through adjacent diamond baguettes. Due to the small size and translucent nature of the diamond baguettes and the light reflected from the similarly colored channel mounting and metallic baguettes, the jewelry setting will appear to present a uniform series of adjacent diamond baguettes.

It is an object of the present invention to provide an enhanced jewelry setting for diamond baguettes which utilizes interleaved metallic baguettes.

It is another object of the present invention to provide a jewelry setting for baguettes which simulates the appearance of uniformly adjacent diamond baguettes.

It is still another object of the present invention to provide an enhanced jewelry setting for baguettes which can employ both rectangular and tapered baguette forms.

It is still yet another object of the present invention to provide an enhanced jewelry setting for baguettes which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
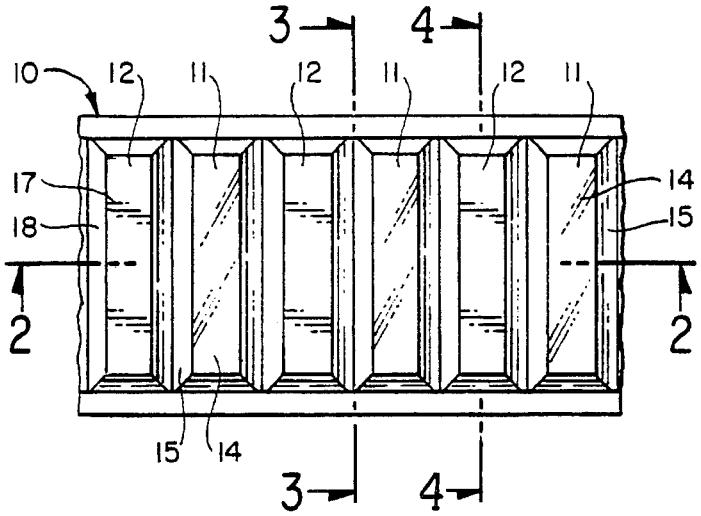
FIG. 1 illustrates a jewelry setting of adjacent rectangular baguettes.

An understanding of the present invention may be best gained by reference to FIG. 1–4. FIG. 1 illustrates an exemplary channel set mounting 10 in which rectangular baguettes 11 and 12 are mounted. Although for the purpose of example only, the channel set 10 as illustrated in FIG. 1 could be used about the circumference of a ring. As stated, an objective of the present invention is to provide an enhanced jewelry setting for interleaved diamond baguettes 11 and metal baguettes 12 which are constructed of identical geometry.

Diamond baguettes 11 comprise a crown portion which extends upwardly from the girdle 13 and includes the table 14. The pavilion covers the entire portion of the baguette extending downwardly from the girdle 13. The visual elements of the crown of diamond baguette 11 comprise table 14 and girdle facets 15.

Figure 2:
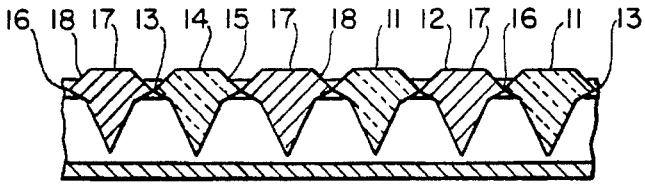
FIG. 2 is a cross-sectional view of the gemstone and metallic baguettes shown in FIG. 1 taken through line 2—2 of FIG. 1.

As stated, the geometry of diamond baguettes 11 and metallic baguettes 12 are identical. As can be seen in FIG. 1 and FIG. 2, metal baguettes comprise a crown portion which extends upwardly from a girdle 16. The visual elements of the crown of a metal baguette 12 comprise table 17 and girdle facets 18. Since diamond baguettes 11 and metal baguettes 12 are rectangular, girdles 13 and 16 are also rectangular. Although the description of the present invention is described in terms of a rectangular baguette, it is understood the scope of the present invention encompasses the use of tapered baguettes.

Figure 3:
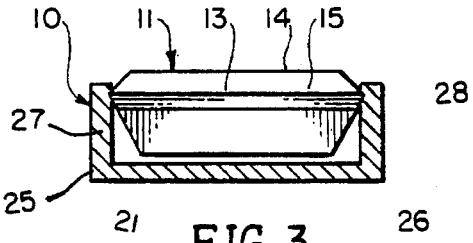
FIG. 3 is a cross-sectional view of the jewelry setting shown in FIG. 1 illustrating a mounted gemstone baguette taken through line 3—3 of FIG. 1.
Figure 4:
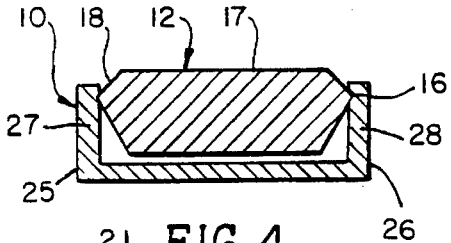
FIG. 4 is a cross-sectional view of the jewelry setting and metallic baguette shown in FIG. 1 taken through line 4—4 of FIG. 1.

In a channel setting 10 constructed in accordance with the present invention, diamond baguettes 11 and metal baguettes 12 are interleaved with one another. As can be best seen in FIG. 2, the girdle 13 of a diamond baguette will be placed adjacent to and be in contact with the girdle 16 of a metal baguette. In cross-section, FIGS. 3 and 4 illustrate the manner in which the diamond baguettes 11 and metal baguettes 12 are secured within channel setting 10. Channel setting 10 comprises an elongated band defined by opposing lateral edges 25 and 26. The diamond baguettes 11 and metal baguettes 12 are mounted between flanges 27 and 28 extending upwardly from surface 21 between lateral edges 25 and 26. As stated previously, it is understood the use of a channel setting is for the purpose of example only, the present invention being equally applicable to a conventional prong setting.

The primary objective of the present invention is to produce a setting of diamond baguettes 11 and metal baguettes 12 which give the illusion of a contiguously set of mounted diamond baguettes 11. This objective is achieved by utilizing the light reflecting and/or refracting characteristics of the diamond baguettes 11, metal baguettes 12 and the surfaces of the channel setting 10.

Figure 5:
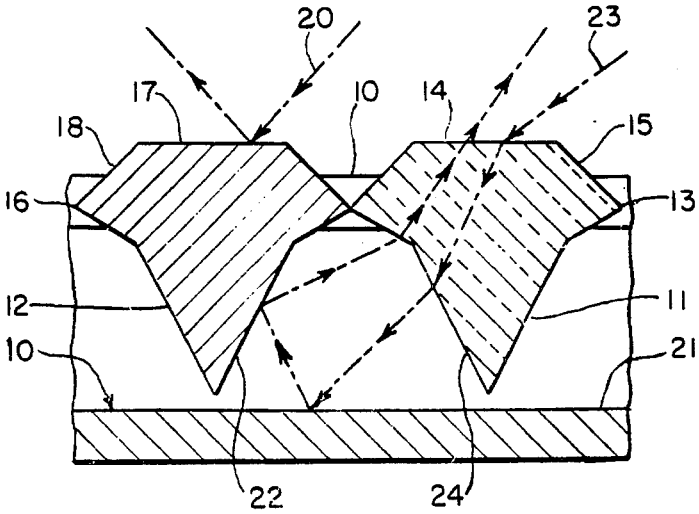
FIG. 5 is a schematic view of adjacent metallic and gemstone baguettes illustrating light impinging upon the table and crown facets thereof.

FIG. 5 schematically illustrates an adjacent diamond baguette 11 and metal baguette 12 and the supporting channel setting 10. The surfaces of metal baguette 12 which are visible to a viewer are table 17 and girdle facet 18. All surfaces of baguette 12 are polished to reflect substantially all light without distortion. As depicted schematically by reference numeral 20, the angle of incident of impinging light (i.e., a line perpendicular to the boundary surface) is equal to the angle of reflection. Simply, substantially all light impinging upon the table 17 or girdle facet 18 will be reflected.

With respect to diamond baguette 11, although indeed light is reflected from table 14 and girdle facet 15, the present invention utilizes the principle that light will be refracted through diamond baguette 11 and then reflected from the surface 21 of setting 10 as well as from pavilion surface 22 of metal baguette 12.

Refraction occurs when light strikes the boundary surface of two different transparent media (e.g., air into diamond). When this occurs, a proportion of the light is reflected back into the first medium and the remainder penetrates into the second medium (i.e., diamond baguette 11), but it undergoes a change of direction in doing so: it is refracted. In FIG. 5, the ray of light depicted by reference numeral 23 is refracted as it passes through diamond baguette 11 and again when it exits baguette 11 into the air. After exiting the pavilion surface 24 of baguette 11, it is reflected from metallic surfaces 21 and 22 after which it re-enters baguette 11 and is refracted when transmitting through diamond baguette 11 and upon exiting into the ambient air.

The result of the reflection of light from the surfaces of metallic baguette 12 and the reflection and refraction through diamond baguette 11 simulates the appearance of a contiguously set of mounted diamond baguettes 11. Since metal baguette 12 is constructed of the same metal or, at the least, is visually the same in color as setting 10, the baguettes 11 and 12 will appear to be a uniform set of adjacent diamond gemstones.

I claim:

1. A jewelry setting for translucent baguettes comprising:

(a) an elongated metallic setting having a reflective bottom surface and having means for mounting baguettes extending upwardly and from opposite sides from said bottom surface;

(b) a plurality of translucent baguettes comprising a visible table and girdle facets mounted between said means for mounting baguettes; and (c) a plurality of metal baguettes having the same geometry as said translucent baguettes and comprising visible and reflective table and girdle facets, said metal baguettes having the same reflective properties as said elongated metallic setting, each of said metal baguettes being mounted between said means for mounting baguettes intermediate mounted translucent baguettes, the girdle facets of said translucent baguettes and metal baguettes being adjacent one another.

2. A jewelry setting as defined in claim 1 wherein said translucent baguettes are diamonds.

3. A jewelry setting for baguettes comprising:

(a) a metal channel setting comprising an elongated, longitudinally disposed band defined by lateral edges and a reflective upper surface and mounting flanges depending upwardly from the edges thereof, said flanges incorporating means for mounting a plurality of baguettes along the longitudinal axis of said band;

(b) a plurality of translucent baguettes comprising a girdle, a table and girdle facets extending upwardly from the girdle and a pavilion and pavilion facets extending downwardly from the girdle, each of said translucent baguettes being mounted between said mounting flanges along the girdle thereof; and (c) a plurality of metal baguettes, each having a girdle with a table and girdle facets extending upwardly thereof and a pavilion and pavilion facets extending downwardly from the girdle, said metal baguettes being geometrically equivalent to the translucent baguettes and having the same reflective properties as said channel setting, each of said metal baguettes being mounted between said mounting flanges and adjacent translucent baguettes whereby impinging light is refracted through and reflected from the table, girdle facets and pavilion facets of said translucent baguettes and reflected from the table, girdle facets and pavilion facets of the metal baguettes and from the reflective upper surface of said channel setting.

4. A jewelry setting as defined in claim 3 wherein said transluscent baguettes are diamonds.

* * * * *